US005908236A

United States Patent [19]

Lueken et al.

[11] Patent Number: 5,908,236

[45] Date of Patent: Jun. 1, 1999

[54] MODULAR BELOW-GRADE LUMINAIRE

[75] Inventors: Thomas Carl Lueken, Walnut; Michael Scott Neuer, Covina, both of Calif.

[73] Assignee: Kim Lighting, Inc., City of Industry, Calif.

[21] Appl. No.: 08/907,110

[22] Filed: Aug. 6, 1997

[51] Int. Cl.[6] ..... F21S 1/06

[52] U.S. Cl. ..... 362/364; 362/372; 362/153; 362/153.1

[58] Field of Search ..... 362/364, 265, 362/372, 153, 153.1, 470, 472

[56] References Cited

U.S. PATENT DOCUMENTS

| | | | |
|---|---|---|---|
| 3,818,428 | 6/1974 | Phipps et al. | 340/29 |
| 3,920,981 | 11/1975 | Bailey | 362/265 |
| 4,320,949 | 3/1982 | Pagano | 354/81 |
| 4,931,914 | 6/1990 | Quiogue | 362/153.1 |
| 5,041,950 | 8/1991 | Tyson | 362/96 |
| 5,481,443 | 1/1996 | Wagner et al. | 362/372 |
| 5,486,988 | 1/1996 | Tyson | 362/364 |
| 5,727,873 | 3/1998 | Tyson | 362/153.1 |
| 5,743,622 | 4/1998 | Ibbitson et al. | 362/153 |

*Primary Examiner*—Sandra O'Shea
*Assistant Examiner*—Todd Reed Hopper
*Attorney, Agent, or Firm*—Lyon & Lyon LLP

[57] ABSTRACT

A luminaire for below-grade use comprises three primary components: 1) a top; 2) a lamp housing; and 3) a bottom. The top comprises a lens and a lens frame, and may include additional components. The lamp housing can be molded in various depths to accommodate various lighting systems, and is frusto-conical with the outer periphery of its bottom larger than the outer periphery of its top. The bottom includes a junction box and a ballast box. The top is secured to the top of the lamp housing, and the bottom is secured to the bottom of the lamp housing, such that the top, bottom, and lamp housing form a lamp housing cavity which houses a lighting system. Both the junction box and the ballast box are covered to separate them from the lighting system. Electrical wiring connects the lighting system to the ballast assembly, and the ballast assembly to field wire splices. Electrical wiring also exits the junction box through a conduit to connect to an external power supply, and may exit through another conduit to connect to another luminaire or the like.

20 Claims, 6 Drawing Sheets

FIG. 3
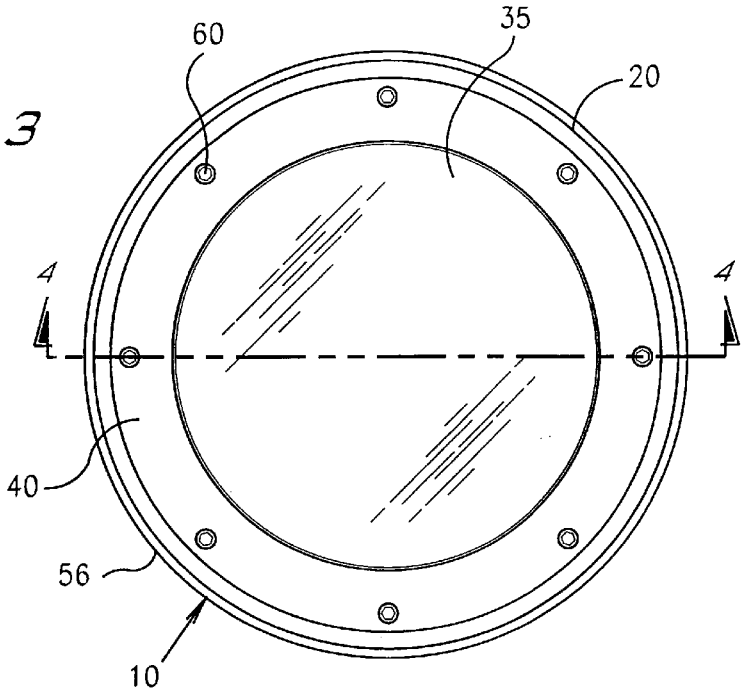
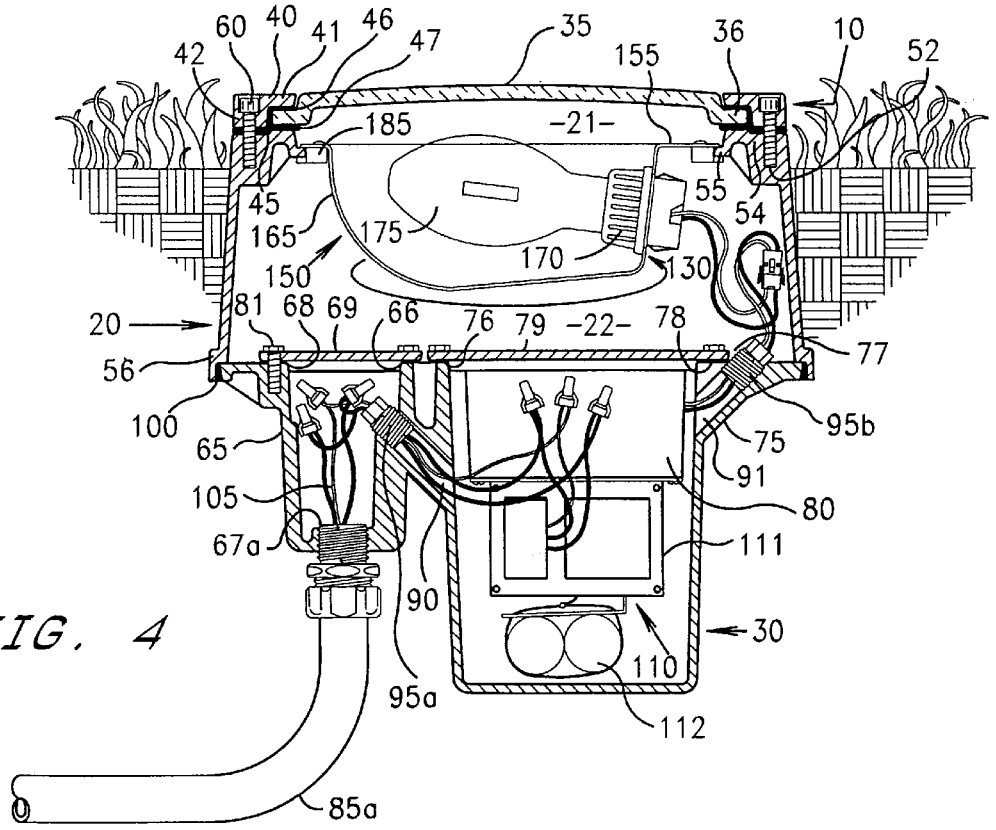
FIG. 4

FIG. 5
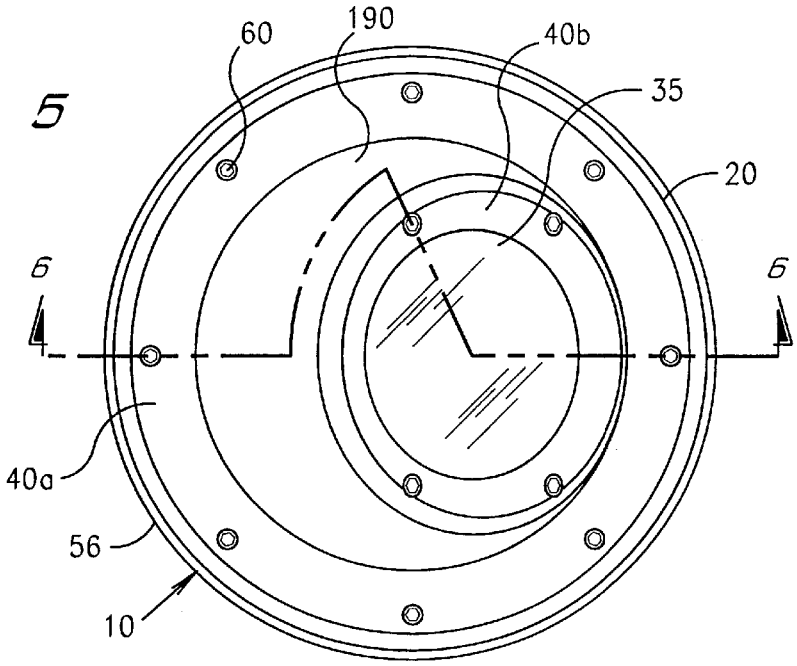
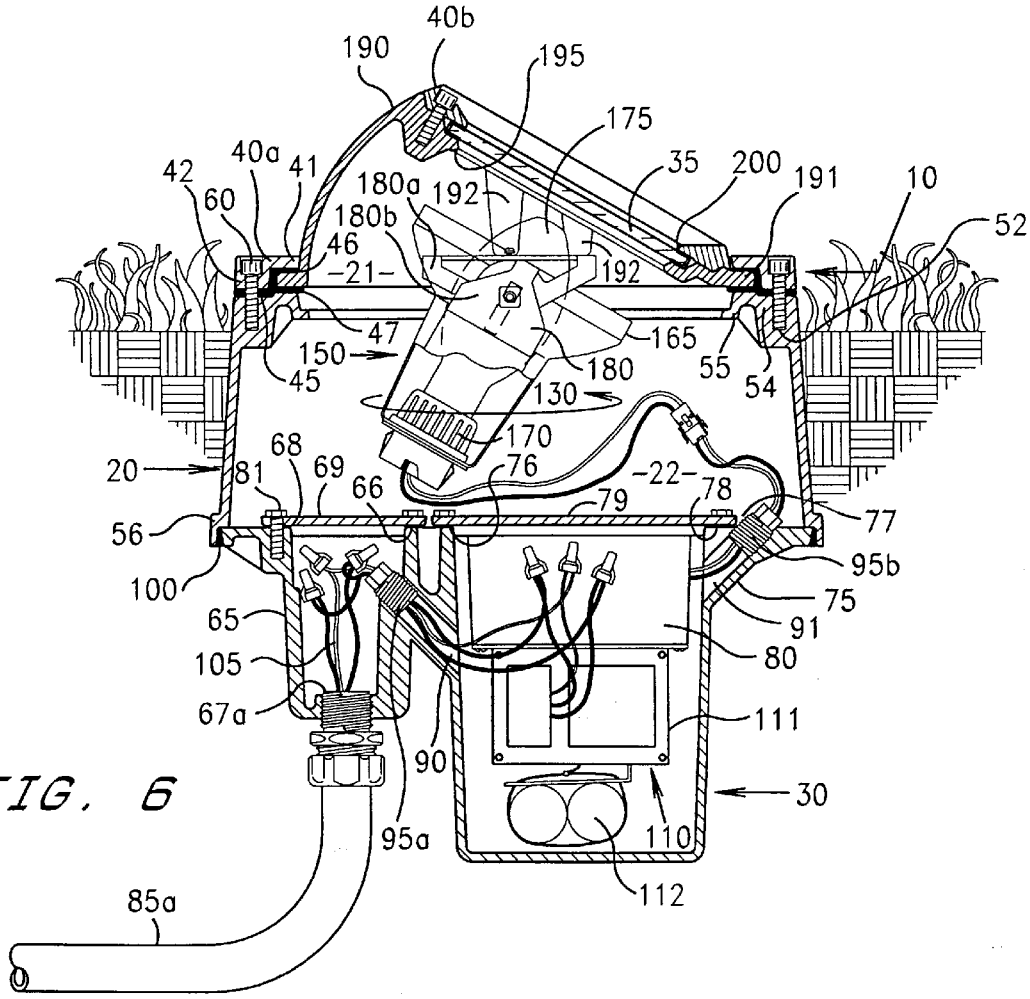
FIG. 6

FIG. 7
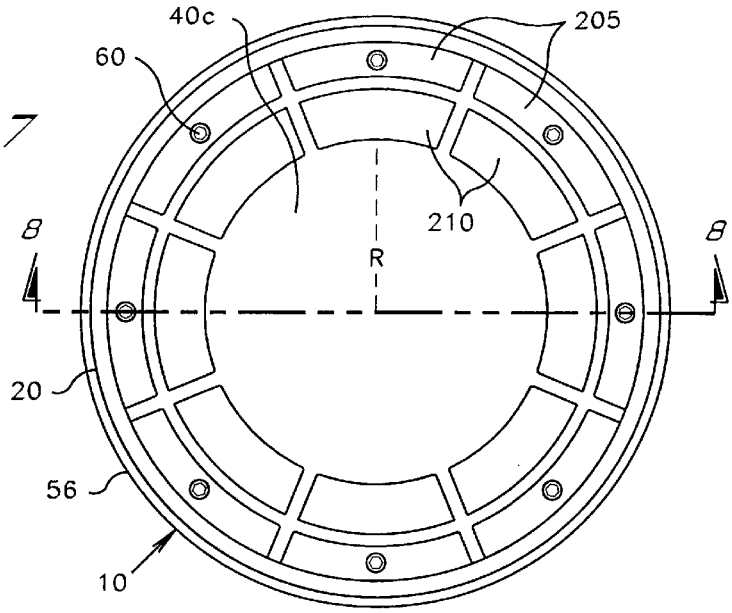
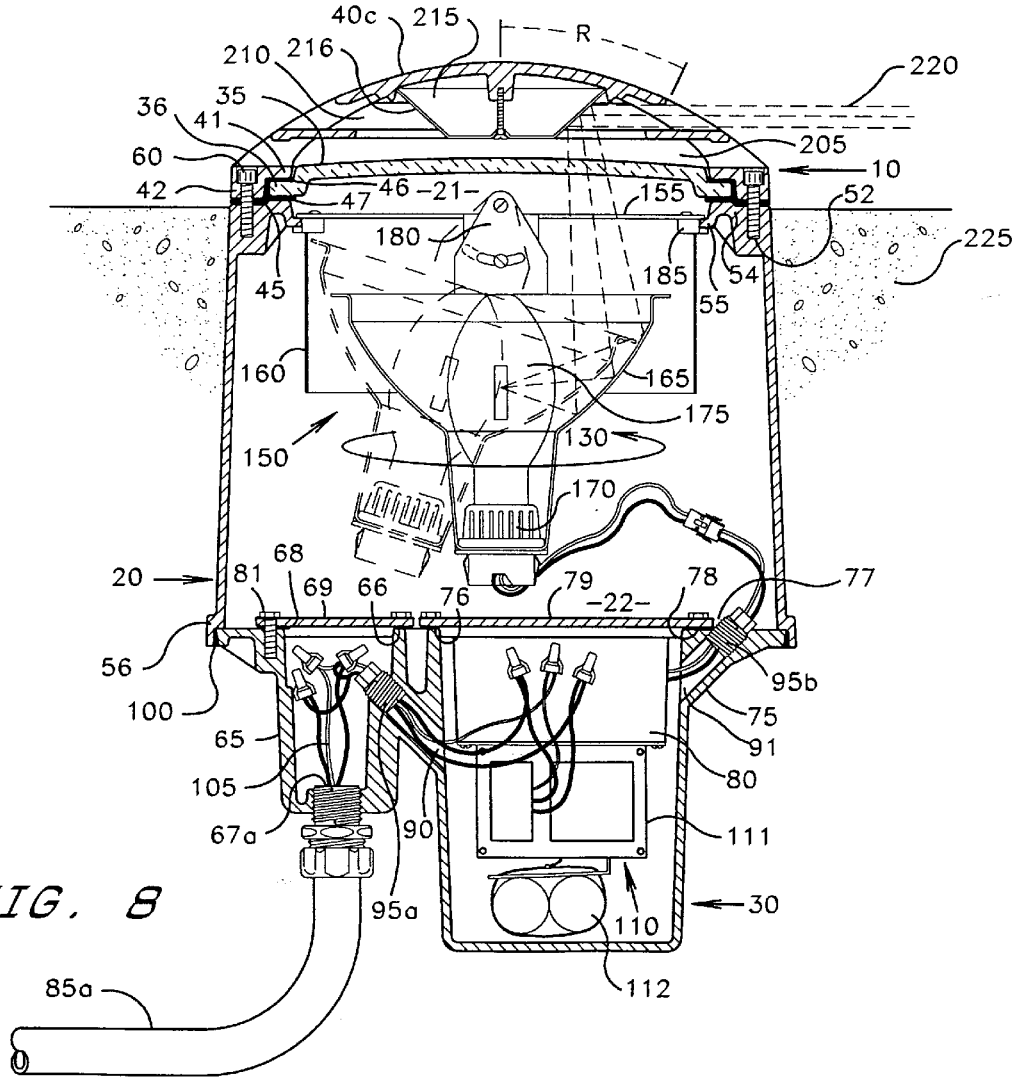
FIG. 8

MODULAR BELOW-GRADE LUMINAIRE

FIELD OF THE INVENTION

The present invention relates to luminaires, and more specifically to below-grade luminaires.

BACKGROUND OF THE INVENTION

Below-grade luminaires have been used for lighting trees and architectural features since the 1950's. They are desirable in locations where above-grade lighting fixtures would distract from the landscape design. In areas such as paved pathways and courtyards where trees are located in wells, this is the only luminaire type that will not pose a hazard to pedestrians because the luminaire is flush with the grade level.

Early configurations included a lamp housing and integral junction box accessible at grade level. The visible junction box was not large, and generally not objectionable as seen at grade level. However, High Intensity Discharge (H.I.D.) lamps soon became the desired light source because of their efficiency and long life. But the H.I.D. lamps required a ballast assembly, and therefore a larger box was needed to house the ballast assembly. The visible above-grade footprint of those luminaires became quite large due to the elements which required access for installation and servicing: the lamp housing, the junction box, and the ballast box.

Because of the large visible footprints, below-grade luminaires were reconfigured with the junction box and ballast box located beneath the lamp housing. This solved the objection to the large visible footprints, but created other problems. First, the luminaires became much deeper creating the concern that installation too close to existing landscaping might damage roots. Second, the luminaires became difficult and more time consuming to install because the junction box was located at the bottom of the lamp housing. This was further aggravated by the inward tapering and narrowing of the luminaire toward the bottom, caused by the draft angle required to mold the luminaire in one piece. Third, the inward tapering made the luminaires more subject to rising out of the soil in cold climates where freezing and thawing cycles occurred.

SUMMARY OF THE INVENTION

As used in this application, "H.I.D." means High Intensity Discharge, "ballast assembly" means any electrical device used to facilitate the operation of an H.I.D. lamp, and "frusto-conical" means in the general shape of the outer surface of the frustum of a cone.

An object of this invention is to provide an improved below-grade luminaire. Another object is to provide a below-grade luminaire which is less likely to rise out of the soil in cold climates where freezing and thawing cycles occur. Another object is to provide a below-grade luminaire with increased working space within the lamp housing cavity, so installation, maintenance, and repairs can be more easily performed. Another object is to provide a below-grade luminaire with a reduced depth, to lessen the possibility of root damage to surrounding landscaping, and to lessen the distance required for a worker to access the junction box and ballast box. Another object is to provide a below-grade luminaire which can be manufactured economically to accommodate various lighting systems.

The objects listed above are obtained by various embodiments of a luminaire comprising three primary components: 1) a top; 2) a lamp housing; and 3) a bottom. The top includes a lens, a lens frame, and a lens gasket. The lamp housing is frusto-conical with the outer periphery of its bottom larger than the outer periphery of its top. The bottom includes a junction box and a ballast box. The top is secured to the top of the lamp housing, and the bottom is secured to the bottom of the lamp housing, such that the top, the bottom, and the lamp housing form a sealed lamp housing cavity which houses a lighting system. Aspects of the various embodiments are discussed in the detailed description.

Because the lamp housing and bottom are separate components, the lamp housing can be molded with a reverse draft making the outer periphery of its bottom larger than the outer periphery of its top. This allows the junction box and ballast box to be placed side by side if desired. This configuration creates more room for a worker to reach inside the lamp housing cavity to make field wire splices or replace the ballast. It also lessens the depth of the luminaire, so damage to surrounding roots is less likely. The shape of the lamp housing also helps to anchor the luminaire into the ground, making it less likely to rise out of the ground in climates where freezing and thawing occur.

The modular construction allows for molding lamp housings with various depths as needed to accommodate various lighting systems. For example, in a particular product line, the lamp housing can be made relatively shallow to accommodate a horizontally disposed lighting system, or slightly deeper to accommodate a vertically disposed lighting system. The tops and bottoms in the product line, however, are compatible with the various lamp housings, and therefore do not have to be remolded for various models. This allows for an economical way to manufacture a particular product line.

Other objects of the present invention will become apparent from the detailed description which follows, when read in conjunction with the drawings.

BRIEF DESCRIPTION OF THE DRAWINGS

FIG. 3 is a top plan view of a second embodiment of the present invention, and is identical to FIG. 1.

FIG. 4 is a cross-section of the second embodiment, along line 4—4 of FIG. 3, showing a horizontally disposed lighting system.

FIG. 5 is a top plan view of a third embodiment of the present invention.

FIG. 6 is a cross-section of the third embodiment, along line 6—6 of FIG. 5, showing an "eyeball" top portion.

FIG. 7 is a top plan view of the a fourth embodiment of the present invention.

FIG. 8 is a cross-section of the fourth embodiment, along line 8—8 of FIG. 7, showing a "speed-bump" top portion.

DETAILED DESCRIPTION

The drawings illustrate preferred embodiments of the present invention: a modular below-grade luminaire. Each of the embodiments comprises three primary components: a top designated generally 10; a lamp housing designated generally 20; and a bottom designated generally 30. Differences in the primary components will be pointed out where applicable, but like components will be referred to by the same reference numbers in the various drawings.

Figure 1:
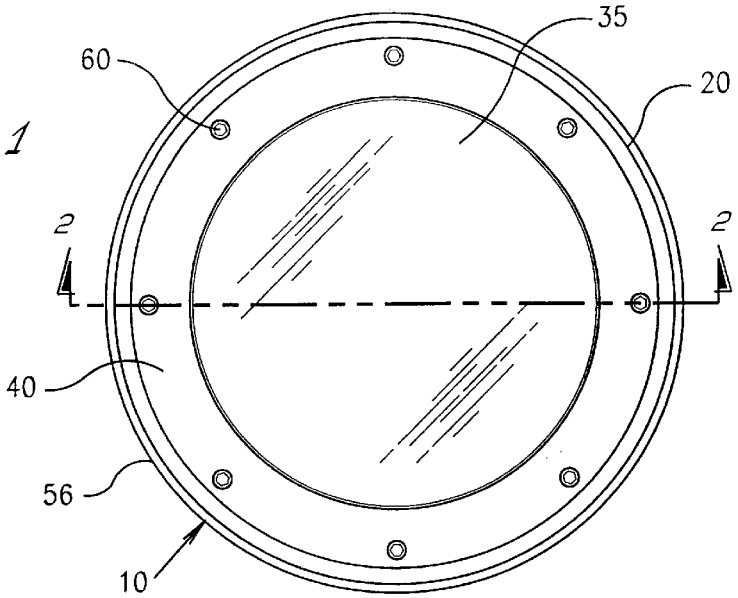
FIG. 1 is a top plan view of a first embodiment of the present invention.
Figure 2:
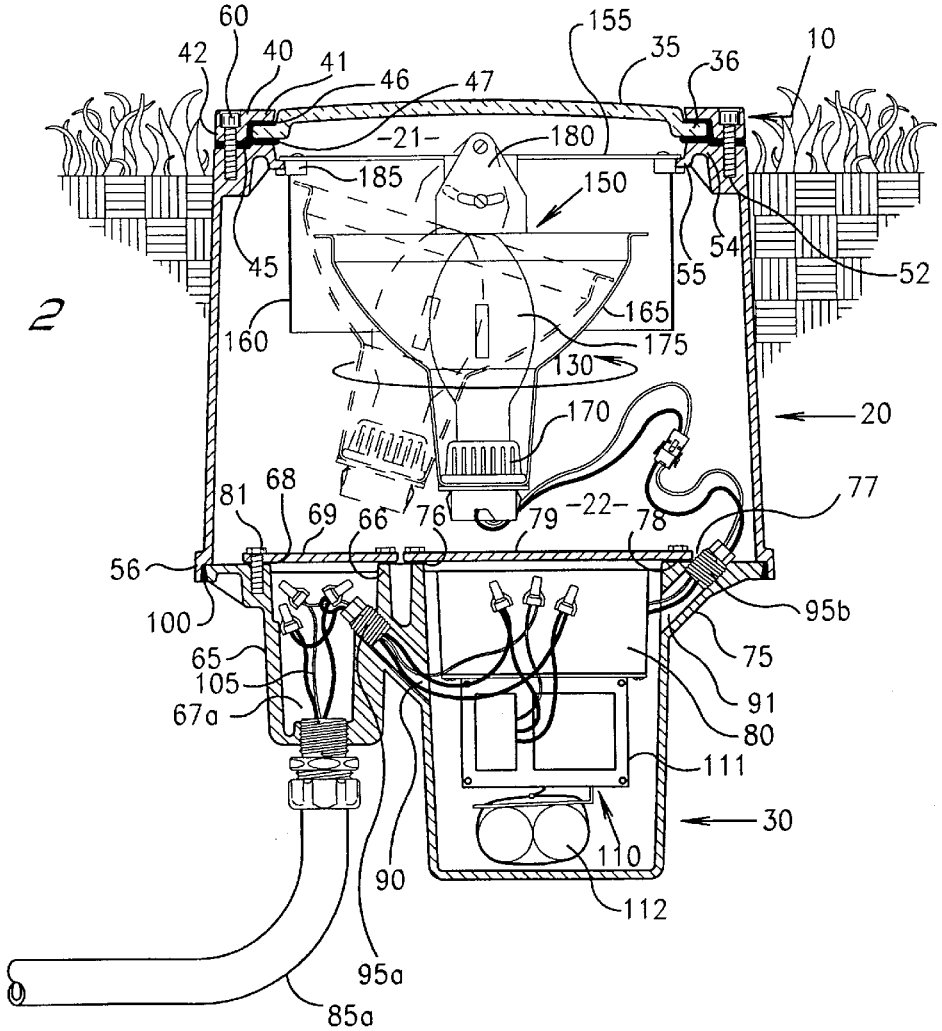
FIG. 2 is a cross-section of the first embodiment, along line 2—2 of FIG. 1, showing a vertically disposed lighting system.

Turning to FIG. 1 and FIG. 2, a first embodiment of the luminaire of the present invention is shown. The top 10 comprises a lens 35, a lens frame 40, and a lens gasket 45. The lens 35 is circular and preferably made of glass. The outer periphery of the lens 35 terminates in a mounting flange 36 such that the lens frame 40 can cover the mounting flange 36 and provide a generally smooth transition from the lens frame 40 to the exposed portion of the lens 35. The lens gasket 45 provides a seal between the top 10 and the lamp housing 20, and is preferably made of silicone. The lens gasket 45 is also preferably annular and has suitable holes evenly spaced around its circumference which correspond to threaded holes 52 in the lamp housing 20. The lens gasket 45 bifurcates inwardly into an upper portion 46 and a lower portion 47, which together enclose the mounting flange 36 of the lens 35. The lens frame 40 is circular and preferably made of cast bronze with a diameter of approximately twelve inches. It has an inward portion 41 and an outward portion 42. The inward portion 41 covers the upper portion 46 of the lens gasket 45, and the outward portion 42 extends downward covering the outer circumference of the lens gasket 45, providing for a tight seal to the lamp housing 20. This construction allows for a generally smooth transition from the lens frame 40 to the exposed portion of the lens 35. The outward portion 42 of the lens frame 40 also has suitable holes evenly spaced around its circumference which correspond to the holes in the lens gasket 45 and to the threaded holes 52 in the lamp housing 20. Lens frame screws 60 preferably made of stainless steel are used to secure the lens frame 40 to the lamp housing 20 by passing through the holes in the lens frame 40, then through the holes in the lens gasket 45, and finally into the threaded holes 52 of the lamp housing 20.

The lamp housing 20 is a single piece comprising an open top 21, an open bottom 22, an upper rim 54 with threaded holes 52, and a lower rim 56, and is preferably molded from composite plastic. The lamp housing 20 is molded using a reverse draft to produce an upwardly and inwardly tapering frusto-conical shape such that the outer periphery of its bottom is larger than the outer periphery of its top. The lamp housing 20 is used to house a lighting system 150, and may be molded in various depths to accommodate different lighting systems. Note FIG. 2 and FIG. 4. The upper rim 54 of the lamp housing 20 has an inner lip 55 which extends inwardly for rotatably mounting the lighting system 150.

Figure 11:
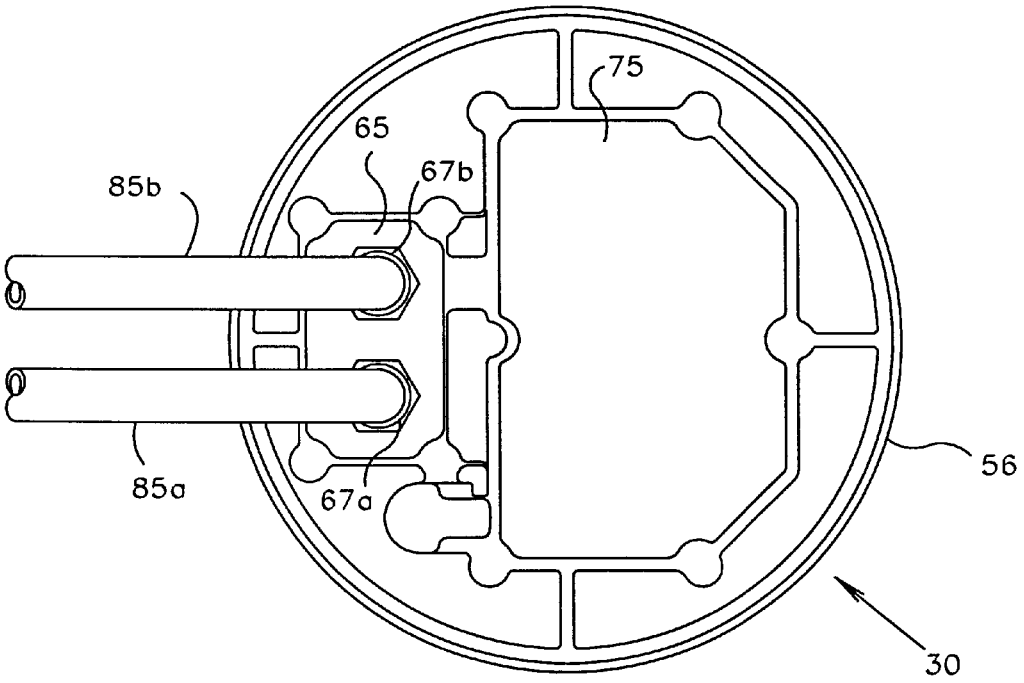
FIG. 11 is a bottom plan view of the first, second, third, and fourth embodiments, cross sections of which are shown in FIG. 2, FIG. 4, FIG. 6, and FIG. 8 respectively.

The bottom 30 is a single piece, circular in plan view (see FIG. 11), and comprises a junction box 65 and ballast box 75. The bottom 30 is also preferably molded from composite plastic. FIG. 2 illustrates the downwardly extending junction box 65 and ballast box 75, both of which have upper rims 66 and 76 respectively, and both of which have an open top to allow access. There are two openings 67*a* and 67*b* at the bottom of the junction box 65 to receive two conduits 85*a* and 85*b* respectively. This allows entry of an external power supply into the junction box 65, and exit from the junction box 65 of electrical wiring to connect to another luminaire or the like.

The junction box 65 and the ballast box 75 are separated by a first communication channel 90, which is defined by a hollow space between walls which separate the junction box 65 and the ballast box 75. The ballast box 75 has a second communication channel 91 defined by a similar hollow space which leads to a second opening 77 at the top of the ballast box 75. A first wire seal and anti-syphon barrier 95*a* and a second wire seal and anti-syphon barrier 95*b* are secured within communication channels 90 and 91 respectively to prevent water from passing therethrough. The wire seal and anti-syphon barriers 95*a* and 95*b* are preferably made of plastic, and are well-known in the art.

The periphery of the bottom 30 is chemically sealed to the lower rim 56 of the lamp housing 20 with an adhesive 100 such as glue. Should the luminaire be desired in metal such as aluminum, the bottom 30 would instead be welded to the lamp housing 20.

Silicone cover gaskets 68 and 78 rest on the upper rims 66 and 76 of the junction box 65 and the ballast box 75 respectively, and covers 69 and 79 rest on top of the cover gaskets 68 and 78 respectively to cover the open tops of the junction box 65 and the ballast box 75 respectively. The covers 69 and 79 are preferably cast aluminum, but may be made from other material such as plastic. They are secured to the bottom 30 by stainless steel screws 81, or any other conventional means. The ballast box cover 79 has integral heat sinks 80, to which the ballast assembly 110 is mounted.

The junction box 65 houses field wire splices 105 which enter or exit through the conduits 85*a* and 85*b*. The field wire splices 105 are electrically connected to a ballast assembly 110 which is housed in the ballast box 75, by electrical wiring extending through the first wire seal and anti-syphon barrier 95*a*. The ballast assembly 110 is mounted to the heat sinks 80, and includes a ballast 111 and capacitors 112 which are required for an H.I.D. lamp to function. Electrical wiring connected to the ballast assembly 110 exits the ballast box 75 through the second wire seal and anti-syphon barrier 95*b* to connect to the lighting system 150.

The top 10, the lamp housing 20, and the bottom 30 are connected as described above to form a lamp housing cavity 130. The lamp housing cavity 130 houses the lighting system 150 which is electrically connected to the ballast assembly 110 as previously described. The lamp housing cavity 130 will vary in size depending on the design of the lamp housing 20. For example, FIG. 2 illustrates a luminaire with a vertically disposed lighting system 150, in which the lamp housing cavity 130 is more voluminous than that of FIG. 4, which illustrates a luminaire with a horizontally disposed lighting system 150.

The lighting system 150 is mounted in the lamp housing cavity 130, and comprises a mounting ring 155, an ultra-violet and heat shield 160, a reflector 165, a socket 170, a lamp 175, and an aiming adjustment bracket 180. The mounting ring 155 rests on top of the ultra violet and heat shield 160 and is secured thereto by any conventional means. The mounting ring 155 is rotatably mounted to the inner lip 55 of the upper rim 54 of the lamp housing 20 by mounting clamps 185. Once the mounting ring 155 is rotated to a desired position, the mounting clamps 185 are tightened to fix the position and prevent further rotation. The ultra violet and heat shield 160 is preferably made of aluminum, and extends downwardly from the mounting ring 155 into the lamp housing cavity 130 to surround and provide support for the upper portion of the reflector 165. The upper portion of the reflector 165 rests within the ultra violet and heat shield 160, and the lower portion of the reflector 165 tapers downwardly to terminate at the socket 170 where it is connected thereto. The socket 170 is secured partially inside the reflector 165, and partially outside the reflector 165. The portion secured inside is fitted to receive the lamp 175, and the portion secured outside provides the means for electrically connecting the lighting system 150 to the ballast assembly 110 as previously described. The lamp 175 is secured in the socket 170 and is surrounded on all sides by the reflector 165, except the path from the lamp 175 to the lens 35 remains substantially unobstructed. The lamp 175 is an H.I.D. lamp which provides more efficient use and a longer life than non-H.I.D lamps. The aiming adjustment bracket 180 is pivotally connected to the mounting ring 155, and fixed to the reflector 165, such that when pivoted, the reflector 165, the socket 170, and the lamp 175, necessarily pivot in conjunction with the aiming adjustment bracket 180 to allow for light from the lamp 175 to be aimed at various angles (see the dashed lines in FIG. 2).

Turning now to FIG. 3 and FIG. 4, a second embodiment of the luminaire of the present invention is shown. The top 10 and the bottom 30 are the same as in the first embodiment. The lamp housing 20 is also the same, except it is designed to house a horizontally disposed lighting system 150 and is therefore more shallow than that of the first embodiment, and upwardly tapers at a different angle to maintain compatibility with the top 10. In this configuration, the lighting system 150 performs better when raised close to the lens 35, in which case the reflector 165 is capable of serving the functions of the aiming adjustment bracket 180 (FIG. 2) and ultra violet and heat shield 160 (FIG. 2) and those components are no longer needed. Additionally, the mounting ring 155 in this embodiment is part of the reflector 165. All other aspects of this embodiment are preferably the same as in the first embodiment.

Turning now to FIG. 5 and FIG. 6, a third embodiment of the luminaire of the present invention is shown. The top 10 differs from that of the first and second embodiments, as will be described shortly. The lamp housing 20 is the same as in the first embodiment, except that its depth may vary and it therefore will upwardly taper at a correspondingly different angle to maintain compatibility with the top 10. The bottom 30 is the same as in the first embodiment.

In this embodiment, the top 10 has an "eyeball" lens shell 190 to hold and project the lens 35 at a predetermined angle. This may be desirable, for example, where it is not necessary to have the lens 35 substantially flush with grade level and the angled position of the lens 35 can be used to better light surrounding landscaping. Additionally, the lens shell 190 may be adjusted to point in various directions by loosening the lens frame screws 60. The lens shell 190 has a mounting flange 191 similar to that of the lens 35 in the first and second embodiments, and is secured between a lens shell frame 40*a* and the lamp housing 20 by the lens gasket 45, similar to how the lens 35 is secured between the lens frame 40 and the lamp housing 20 in the first and second embodiments. Thus, the lens shell frame 40*a* in this embodiment is the component referred to as the lens frame 40 in the first and second embodiments. This is best seen in FIG. 6, and for this embodiment the component will be referred to as the lens shell frame 40*a*. The component in this embodiment which frames the lens 35 will be referred to as the lens frame 40*b*.

A portion of the lens shell 190 arcs upward toward the lens 35 from at least a portion of the lens shell frame 40*a*. The lens shell 190 has bosses 192 molded into its inside surface which are used for attaching the aiming adjustment bracket 180, and it also has an open top with an upper rim 195, similar to the upper rim 54 of the lamp housing 20. A lens frame 40*b* is secured to the upper rim 195 of the lens shell 190 in a manner similar to how the lens shell frame 40*a* is secured to the lamp housing 20. The lens 35 does not have a mounting flange 36 (FIG. 2), but is nonetheless secured between the lens frame 40*b* and the upper rim 195 of the lens shell 190, and a second lens gasket 200 provides a suitable seal. The lens frame 40*b* is circular and preferably made of cast bronze, just as the lens shell frame 40*a*.

The lighting system 150 in this embodiment has the aiming adjustment bracket 180, but does not have the ultra violet and heat shield 160 or the mounting ring 155. The aiming adjustment bracket 180 in this embodiment has two pieces, 180*a* and 180*b*. The first piece 180*a* is connected to the lens shell 190 at bosses 192. The second piece 180*b* is pivotally connected to the first piece 180*a*, but is fixed to the reflector 165 such that when pivoted, the reflector 165, the socket 170, and the lamp 175, necessarily pivot in conjunction with the aiming adjustment bracket 180. All other aspects of this embodiment are preferably the same as in the first embodiment.

Turning now to FIG. 7 and FIG. 8, a fourth embodiment of the luminaire of the present invention is shown. The top 10 differs from that of the first, second, and third embodiments, as will be described shortly. The lamp housing 20 and the bottom 30 are the same as in the first embodiment.

In this embodiment, the top 10 has a "speed-bump" lens frame 40*c* which rises above grade level and is shaped substantially like the outer surface of a portion of a sphere. The lens frame 40*c* is preferably cast bronze, and has a first series of open spaces 205 dispersed in a predetermined pattern around its periphery, and a second series of open spaces 210 dispersed in a predetermined pattern at a level above the first series of open spaces 205. The upper most portion of the lens frame 40*c* has no open spaces out to a predetermined radial distance R, and thus prevents light from passing therethrough. A light-directing component 215 preferably made of stainless steel is attached to the underside of the upper most portion of the lens frame 40*c* and has an angled surface 216 such that when light hits the light-directing component 215 the light is directed through the open spaces 205 and 210 to form substantially horizontal beams of light 220. This embodiment may be desirable, for example, on a driveway, and is shown in FIG. 8 installed in a cement grade 225. All other aspects of this embodiment are preferably the same as in the first embodiment.

Figure 9:
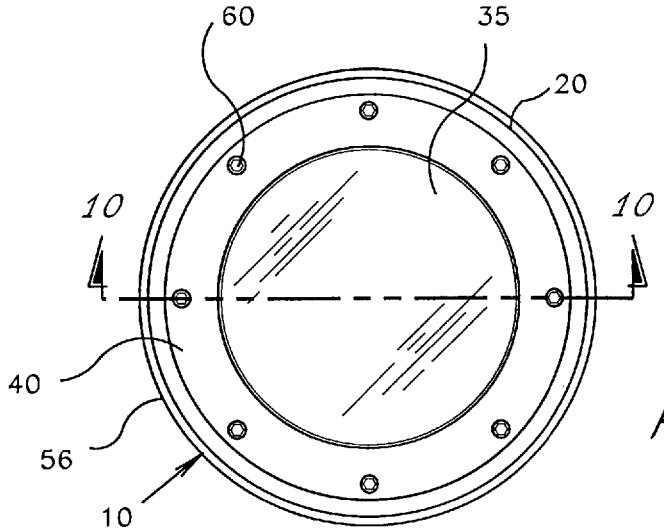
FIG. 9 is a top plan view of a fifth embodiment of the present invention.
Figure 10:
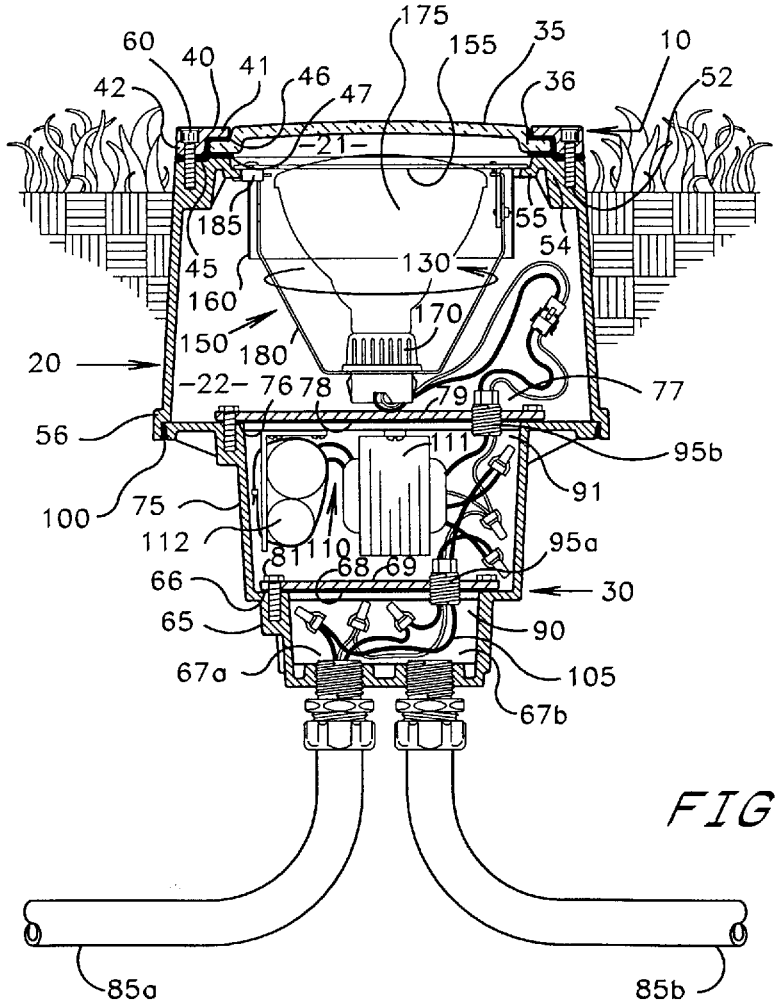
FIG. 10 is a cross-section of the fifth embodiment, along line 10—10 of FIG. 9, showing a two-level bottom portion.

Turning now to FIG. 9 and FIG. 10, a fifth embodiment of the luminaire of the present invention is shown. The top 10 and lamp housing 20 of this embodiment are similar to those of the first embodiment, but the dimensions of this embodiment are smaller as it is designed to provide a smaller footprint. For example, the lens frame 40 preferably has a diameter of approximately nine inches. Due to the smaller dimensions, the bottom 30 is also designed differently than in the other embodiments, to enable it to still house the ballast assembly 110 and field wire splices 105.

The bottom 30 is a single two-level piece, preferably molded from composite plastic, with the ballast box 75 located above the junction box 65. The ballast box 75 and the junction box 65 are both covered by covers 79 and 69 respectively, but in this embodiment the covers 79 and 69 must have suitable openings which form the first and second communication channels 90 and 91 respectively. The ballast assembly 110 is secured to the underside of the ballast box cover 79, so that the junction box 65 is accessible through the ballast box 75 with minimal interference. Also, the lighting system 150 may or may not have a reflector 165, and is shown in FIG. 10 without a reflector 165. All other aspects of this embodiment are preferably the same as in the first embodiment.

While various embodiments are illustrated in the drawings and have just been described herein, it will be apparent to those skilled in the art that many modifications could be made to the embodiments without departing from the inventive concepts described. Accordingly, the invention is not to be restricted except by the claims which follow.

What is claimed is:

1. A below-grade luminaire comprising:

a top comprising a lens and a lens frame;

a bottom comprising a junction box and a ballast box, the junction box having at least one opening for receiving at least one conduit; and a lamp housing having an open top with an outer periphery, an open bottom with an outer periphery, an upper rim, and a lower rim, the lamp housing upwardly and inwardly tapering in a frusto-conical manner such that the outer periphery of its bottom is larger than the outer periphery of its top, the lamp housing sealably connected at its upper rim to the top, and sealably connected at its lower rim to the bottom, whereby a lamp housing cavity is formed within the lamp housing.

2. The luminaire as in claim 1 wherein the bottom and the lamp housing are made of composite plastic, and the lamp housing is chemically sealed to the bottom by an adhesive.

3. The luminaire as in claim 1 wherein the junction box and the ballast box both have an open top and an upper rim, the junction box and the ballast box are substantially adjacent to one another and both extend downwardly, and wherein the luminaire further comprises a junction box cover which covers the open top of the junction box, a ballast box cover which covers the open top of the ballast box, and means for sealably connecting the junction box cover and the ballast box cover to the junction box and the ballast box respectively.

4. The luminaire as in claim 1 wherein the luminaire further comprises a lens gasket which rests on the upper rim of the lamp housing and bifurcates inwardly into an upper portion and a lower portion, and wherein the lens has a mounting flange which rests between the upper portion and the lower portion of the lens gasket such that the lens gasket encloses the mounting flange and provides a seal between the top and the lamp housing.

5. The luminaire as in claim 3 wherein the junction box and the ballast box communicate with each other by a first communication channel, and the ballast box communicates with the lamp housing cavity by a second communication channel.

6. The luminaire as in claim 5 further comprising a ballast assembly housed within the ballast box, and a lighting system mounted in the lamp housing cavity and electrically connected to the ballast assembly.

7. The luminaire as in claim 6 wherein the lighting system comprises a socket, a lamp secured in the socket, and a reflector rotatably mounted to the upper rim of the lamp housing, and wherein the reflector surrounds the lamp on all sides except to leave the path from the lamp to the lens substantially unobstructed, and wherein the lighting system is electrically connected to the ballast assembly.

8. The luminaire as in claim 6 wherein the lighting system comprises a socket, a lamp secured in the socket, a reflector surrounding the lamp on all sides except to leave the path from the lamp to the lens substantially unobstructed, an ultra violet and heat shield rotatably mounted to the upper rim of the lamp housing and downwardly extending into the lamp housing cavity to surround and provide support for the upper portion of the reflector, and an aiming adjustment bracket pivotally attached to the ultra violet and heat shield and secured to the reflector for directing light from the lamp through the lens at various angles, and wherein the lighting system is electrically connected to the ballast assembly.

9. The luminaire as in claim 1 wherein the lens frame is shaped substantially like the outer surface of a portion of a sphere, and wherein the lens frame has first series of open spaces dispersed in a predetermined pattern around its periphery such that light from within the lamp housing cavity could travel through the open spaces, and wherein the upper most portion of the lens frame has no open spaces out to a predetermined radial distance.

10. The luminaire as in claim 9 wherein the lens frame further has a second series of open spaces dispersed in a predetermined pattern at a level above the first series of open spaces, and wherein a light-directing component is attached to the underside of the upper most portion of the lens frame and has an angled surface such that light from within the lamp housing cavity is reflected off of the angled surface and directed through at least one of the first and second series of open spaces to form at least one substantially horizontal beam of light.

11. The luminaire as in claim 10 wherein the bottom and the lamp housing are made of composite plastic, and the lamp housing is chemically sealed to the bottom by an adhesive.

12. The luminaire as in claim 1 wherein the ballast box is above the junction box, and the ballast box and the junction box both have an open top and an upper rim.

13. The luminaire as in claim 12 wherein the bottom and the lamp housing are made of composite plastic, and the lamp housing is chemically sealed to the bottom by an adhesive.

14. The luminaire as in claim 12 further comprising a junction box cover which covers the open top of the junction box, a ballast box cover which covers the open top of the ballast box, and means for sealably connecting the junction box cover and the ballast box cover to the junction box and the ballast box respectively.

15. The luminaire as in claim 14 further comprising a ballast assembly housed within the ballast box, and a lighting system housed within the lamp housing cavity and electrically connected to the ballast assembly.

16. The luminaire as in claim 15 wherein the lighting system is electrically connected to the ballast assembly through a first communication channel which extends through the ballast box cover, and wherein the ballast box communicates with the junction box by a second communication channel which extends through the junction box cover.

17. A below-grade luminaire comprising:

a top having a lens shell frame, a lens shell with a mounting flange and an upper rim, a lens frame, and a lens secured between the lens frame and the upper rim of the lens shell, the lens shell mounting flange being substantially covered by the lens shell frame;

a bottom having a junction box and a ballast box, the junction box having at least one opening for receiving at least one conduit; and a lamp housing having an open top with an outer periphery, an open bottom with an outer periphery, an upper rim, and a lower rim, the lamp housing upwardly and inwardly tapering in a frusto-conical manner such that the outer periphery of its bottom is larger than the outer periphery of its top, the lamp housing sealably connected at its upper rim to the top, and sealably connected at its lower rim to the bottom, whereby a lamp housing cavity is formed within the lamp housing.

18. The luminaire as in claim 17 wherein at least a portion of the lens shell arcs upward toward the lens from at least a portion of the lens shell frame, and wherein the lens shell holds and projects the lens at a predetermined angle.

19. The luminaire as in claim 18 wherein the bottom and the lamp housing are made of composite plastic, and the lamp housing is chemically sealed to the bottom by an adhesive.

20. The luminaire as in claim 17 further comprising a lighting system housed substantially within the lamp housing cavity and electrically connected to a ballast assembly housed substantially within the ballast box.

* * * * *